US008348365B2

(12) United States Patent
Huang et al.

(10) Patent No.: US 8,348,365 B2
(45) Date of Patent: Jan. 8, 2013

(54) INKJET PRINTING SYSTEM

(75) Inventors: Ke Ming Huang, Hsin-Chu (TW); Hung Chuan Lo, Hsin-Chu (TW); Chin Tsung Chen, Hsin-Chu (TW); Kwo Yuan Shi, Hsin-Chu (TW)

(73) Assignee: Microjet Technology Co., Ltd., Hsin-Chu (TW)

( * ) Notice: Subject to any disclaimer, the term of this patent is extended or adjusted under 35 U.S.C. 154(b) by 55 days.

(21) Appl. No.: 13/155,807

(22) Filed: Jun. 8, 2011

(65) Prior Publication Data

US 2011/0316907 A1 Dec. 29, 2011

(30) Foreign Application Priority Data

Jun. 24, 2010 (CN) ..... 2010 1 0217366

(51) Int. Cl.
*B41J 2/195* (2006.01)
*B41J 2/17* (2006.01)

(52) U.S. Cl. ..... 347/7; 347/84

(58) Field of Classification Search ..... 347/7, 16, 347/19, 84–87

See application file for complete search history.

(56) References Cited

U.S. PATENT DOCUMENTS 6,435,638 B1 * 8/2002 Wilson et al. ..... 347/7
7,156,506 B2 * 1/2007 Tsukada et al. ..... 347/85
7,731,344 B2 * 6/2010 Iwamuro et al. ..... 347/86

* cited by examiner

*Primary Examiner* — An Do
(74) *Attorney, Agent, or Firm* — Muncy, Geissler, Olds & Lowe, PLLC

(57) ABSTRACT

An inkjet printing system includes: a liquid supply tank; a print device with at least one print cartridge, wherein there is an altitude difference between the print cartridge and the liquid supply tank; an internal pressure-adjusting device connecting to the liquid supply tank and the print cartridge; and working software for calculating a preliminary altitude, and a predetermined liquid supplementing altitude of the print cartridge. When a liquid level of a liquid inside the print cartridge is lower than the preliminary altitude and below an lower limit of the predetermined liquid supplementing altitude, the working software controls the internal pressure-adjusting device to suck partial gas from the print cartridge into the liquid supply tank to increase a negative pressure inside the print cartridge, and the liquid stored in the liquid supply tank is introduced into the print cartridge to balance the negative pressure inside the print cartridge.

11 Claims, 7 Drawing Sheets

INKJET PRINTING SYSTEM

CROSS REFERENCE TO RELATED APPLICATION

This application claims the benefits of the People's Republic of China Patent Application Serial Number 201010217366.6, filed on Jun. 24, 2010, the subject matter of which is incorporated herein by reference.

BACKGROUND OF THE INVENTION

1. Field of the Invention

The present invention relates to an inkjet printing system.

2. Description of Related Art

Inkjet printers can be easily operated, and perform a printing process on various print media. Hence, customers generally use the inkjet printers as daily print means. When the inkjet printers are used over a period of times, ink cartridges have to be replaced by new ones due to the elimination of ink. The most convenient method for replacing the ink cartridge is to discard an old one and then install a new one. However, this method may cause lots of ink cartridges wasted. In addition, the ink cartridges are expensive, so the customers have to afford another expenses on the ink cartridges. In order to reduce the print cost, avoid waste of resource, and meet the requirement of environmental protection, a continuous ink supply system using the same ink cartridge is developed.

The existing continuous ink supply system generally is an external continuous ink supply system. According to this ink supply systems, an ink supply cartridge is disposed outside an inkjet printer, and the ink supply cartridge connects to a print cartridge inside the inkjet printer through pipelines. The ink inside the ink supply cartridge is introduced into the print cartridge through siphons. When the print cartridge performs a printing process, the ink can be continuously introduced into the print cartridge. Therefore, the ink supply cartridge can continuously supply ink to the print cartridge, and a purpose of continuous ink supplement can be accomplished.

Although the conventional continuous ink supply system can accomplish the purpose of continuous ink supplement, customers still have to disassemble/assemble the print cartridges or the pipelines between the ink supply cartridges and the print cartridges to replace the ink supply cartridges, when the ink stored in the ink supply cartridges runs out. During the process for replacing the ink supply cartridges, the connection of the pipelines may not be sealed well, so the negative pressure inside the pipelines may be different from the negative pressure that the ink is originally supplied. In this case, the pressure inside the pipelines is changed, so the negative pressure inside the print cartridge is gradually eliminated during the process for replacing the ink supply cartridges. Therefore, the problem of ink leakage is generated, and the print quality is undesirable and abnormal.

In addition, the print device of the conventional inkjet printer is only provided with single print head, so the manufacturing cost of the inkjet printer is low. Although customers can accept the print speed of the conventional inkjet printer, higher print speed is still required as the science and technology rapidly develops. In addition, although the mechanism of the inkjet printer can be modified to meet the demand for high print speed, the manufacturing cost is also increased.

Furthermore, when the conventional inkjet printer is used, the motion between the inkjet print device and the print object can only be in a straight line. Hence, the conventional inkjet printer cannot meet the requirement for performing the printing process on various print media with different shapes.

Therefore, it is desirable to provide an inkjet printing system to obviate the aforementioned problems, wherein the inkjet printing system is equipped with a low cost and high speed continuous ink supply system, and the printing path thereof is not limited to a straight path.

SUMMARY OF THE INVENTION

According to the conventional continuous liquid supply system, when the print cartridge is disassembled many times, the negative pressure inside the print cartridge is gradually eliminated, and thereby the problem of ink leakage is generated. In this case, the print quality is undesirable and abnormal. In addition, the ink is introduced from the external ink supply cartridge into the print cartridge by hand, so the human resource cost is high and the purpose of automatic manufacture cannot be accomplished. Furthermore, there is also a disadvantage that the motion between the inkjet print device and the print object can only be in a straight line. Based on the aforementioned disadvantages, an object of the present invention is to provide an inkjet printing system.

To achieve the object, a broad aspect of the present invention is to provide an inkjet printing system, which comprises: a liquid supply tank for storing a liquid; a print device for performing a printing process on a print medium, wherein the print device comprises at least one print cartridge, each print cartridge is provided with plural nozzles, and there is an altitude difference between the print cartridge and the liquid supply tank; an internal pressure-adjusting device, which connects to the liquid supply tank and the print cartridge, and performs a suction process on the print cartridge; and working software for calculating and defining a preliminary altitude of the print cartridge, a predetermined liquid supplementing altitude of the print cartridge, and a working time of the internal pressure-adjusting device. According to the inkjet printing system of the present invention, when a liquid level of a liquid inside the print cartridge is lower than the preliminary altitude and below an lower limit of the predetermined liquid supplementing altitude, the working software controls the internal pressure-adjusting device to suck partial gas from the print cartridge into the liquid supply tank to increase a negative pressure inside the print cartridge, and the liquid stored in the liquid supply tank is introduced into the print cartridge to balance the negative pressure inside the print cartridge.

Other objects, advantages, and novel features of the invention will become more apparent from the following detailed description when taken in conjunction with the accompanying drawings.

DETAILED DESCRIPTION OF THE PREFERRED EMBODIMENT

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

The inkjet printing system of the present invention comprises a liquid supply tank, and an internal pressure-adjusting device. The inkjet printing system of the present invention can automatically and continuously supply liquid, automatically adjust the negative pressure inside the print cartridge of the print device, rapidly perform a printing process with large area, print on a print medium in a non-straight path, and maintain a fixed altitude between a print cartridge and a print medium to keep a suitable printing distance.

Figure 1A:
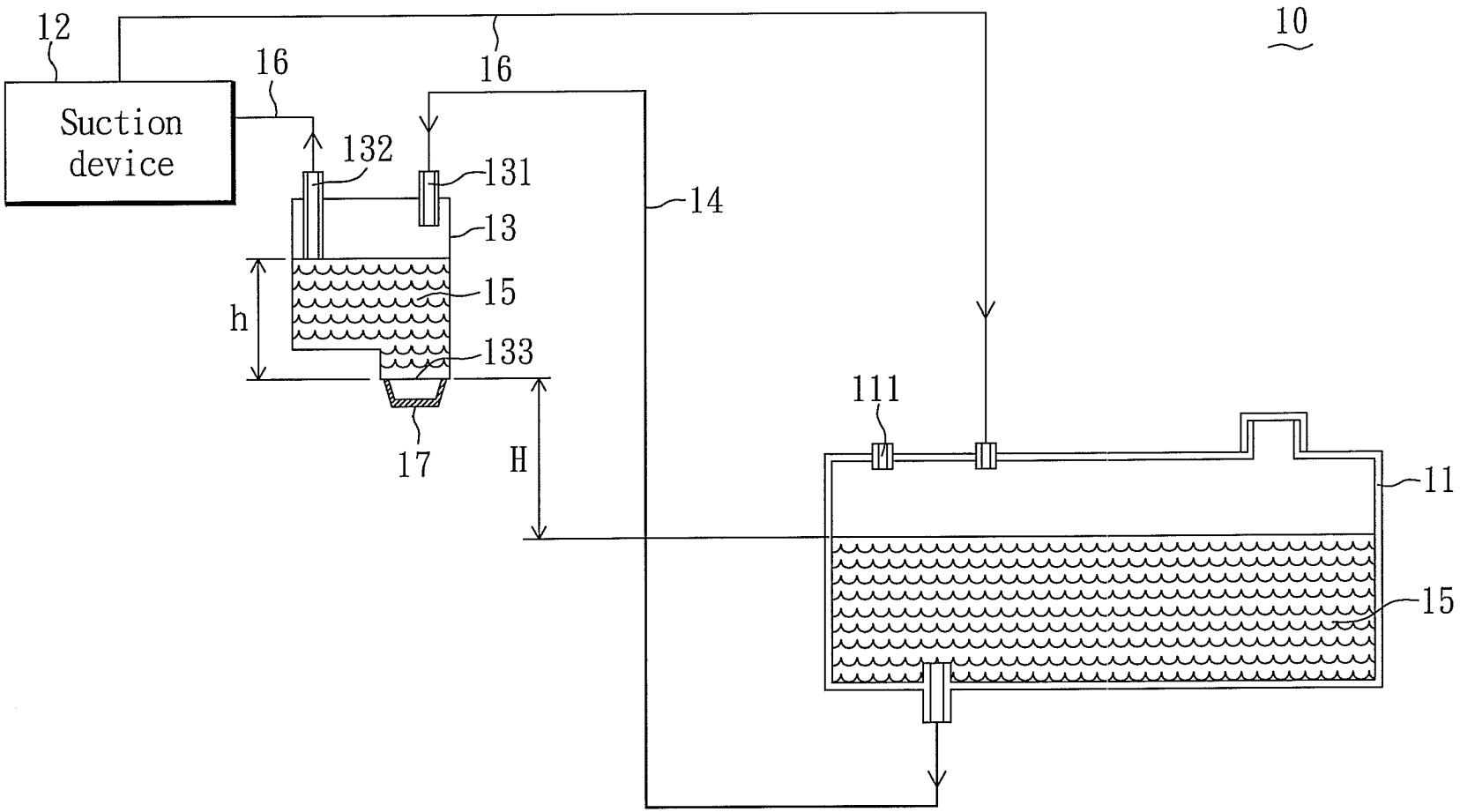
FIG. 1A is a perspective view showing a liquid supply tank, a print cartridge, and an internal pressure-adjusting device of an inkjet printing system according to a first preferred embodiment of the present invention.

FIG. 1A is a perspective view showing a liquid supply tank, a print cartridge, and an internal pressure-adjusting device of an inkjet printing system of the present invention. As shown in FIG. 1A, a continuous liquid supply device 10 comprises a liquid supply tank 11, an internal pressure-adjusting device, and a print cartridge 13 of inkjet printing system of the present invention. In the present embodiment, the internal pressure-adjusting device is a suction device 12 such as a pump, but the present invention is not limited thereto. Herein, a liquid 15 for printing is stored in the liquid supply tank 11. The liquid 15 stored in the liquid supply tank 11 is introduced into the print cartridge 13 through the introduction of a first connection pipeline 14. The gas inside the print cartridge 13 and the excess liquid 15 is introduced back into the liquid supply tank 11 through the introduction of a second connection pipeline 16 and the suction process of the suction device 12. In the present embodiment, the liquid 15 is ink.

As shown in FIG. 1A, the print cartridge 13 further comprises a delivery pipe 131 and a suction pipe 132, wherein the delivery pipe 131 connects to the first connection pipeline 14, and the suction pipe 132 connects to the second connection pipeline 16. In addition, the position of the print cartridge 13 of the present embodiment is higher than that of the liquid supply tank 11, and there is an altitude difference H between a liquid level of the liquid 15 inside the liquid supply tank 11 and nozzles 133 at the bottom of the print cartridge 13. The altitude difference H can provide a normal negative pressure to the print cartridge 13, and the negative pressure inside the print cartridge 13 is maintained in a rage of −4 mmHg to −12 mmHg. Hence, the negative pressure inside the print cartridge 13 can maintain in a balance state, and a constant print quality can be obtained.

Figure 1B:
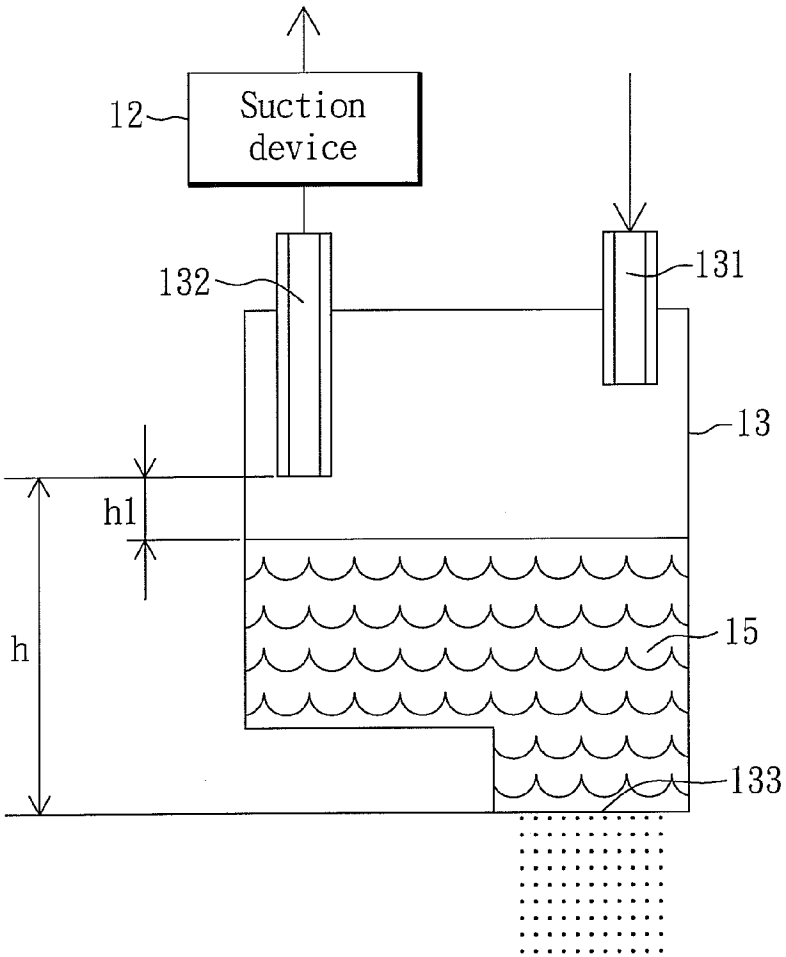
FIG. 1B is a perspective view showing that the print cartridge represented in FIG. 1A is in a state of the requirement of the liquid supplement.

As shown in FIGS. 1A and 1B, a preliminary altitude h and a predetermined liquid supplementing altitude h1 of the print cartridge 13 are defined, wherein the preliminary altitude h of the print cartridge 13 is a vertical height from the nozzles 133 to the bottom of the suction pipe 132, and the predetermined liquid supplementing altitude h1 of the print cartridge 13 is a vertical height from a predetermined position at the preliminary altitude h of the print cartridge 13 to the bottom of the suction pipe 132. The preliminary altitude h and the predetermined liquid supplementing altitude h1 of the print cartridge 13 are calculated by working software of the inkjet printing system. In addition, the predetermined position can be a start position for supplying liquid, which is defined based on the actual demand.

Before the suction device 12 performs the suction process on the print cartridge 13, the print cartridge 13 has to be moved to a position of a capper 17 in a maintenance portion, in order to seal the nozzles 133 at the bottom of the print cartridge 13. Hence, it can be ensured that the air from the outside cannot flow into the print cartridge 13 through the nozzles 133, when the suction device 12 performs the suction process. Once the internal space of the print cartridge 13 is full of gas, the printing process cannot be performed normally. In the present embodiment, the liquid supply tank 11 further comprises an air vent 111 for balancing the interior negative pressure inside the liquid supply tank 11.

Figure 1D:
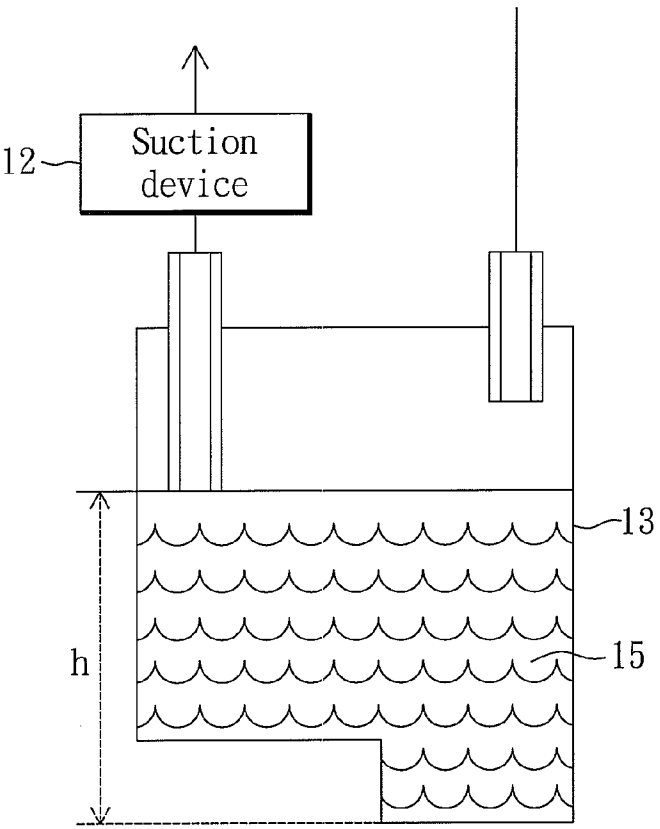
FIG. 1D is a perspective view showing that the ink supplement to the print cartridge represented in FIG. 1B is completed.
Figure 1C:
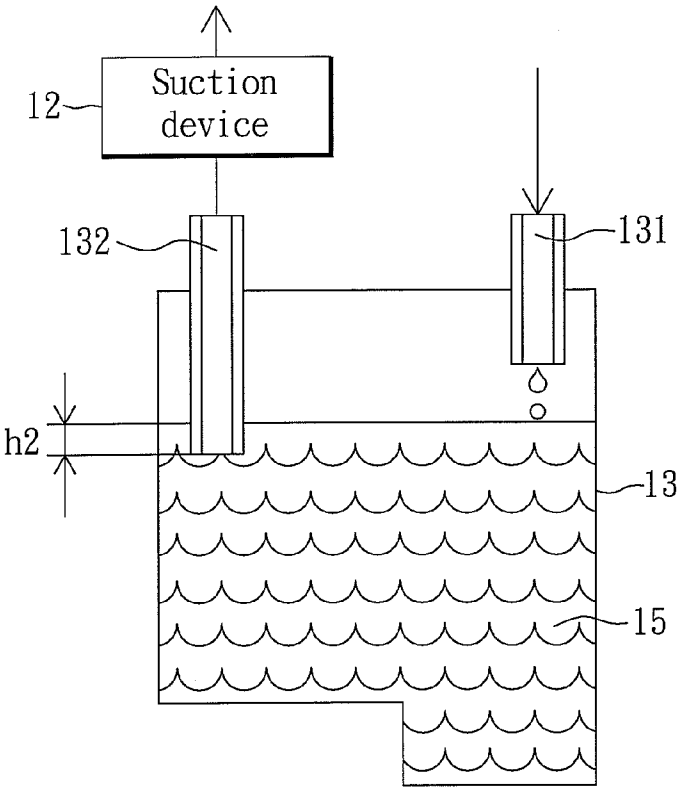
FIG. 1C is a perspective view showing that the liquid level of the print cartridge represented in FIG. 1B is higher than a predetermined altitude.

FIG. 1B is a perspective view showing that the print cartridge represented in FIG. 1A is in a state of the requirement of the liquid supplement. As shown in FIGS. 1A and 1B, when the nozzles 133 of the print cartridge 13 continuously sprays link until a liquid level of the liquid 15 inside the print cartridge 13 is lower than the preliminary altitude h and below an lower limit of the predetermined liquid supplementing altitude h1, i.e. the liquid level of the liquid 15 inside the print cartridge 13 is lower than the predetermined liquid supplementing altitude h1 below the suction pipe 132, the suction device 12 is started to perform a suction process on the internal space of the print cartridge 13. The suction device 12 sucks the gas inside the print cartridge 13 into the liquid supply tank 11 through the suction pipe 132 and the second connection pipeline 16, so the negative pressure inside the print cartridge 13 is gradually increased. Hence, the liquid 15 stored inside the liquid supply tank 11 can be introduced into the print cartridge 13 through the first connection pipeline 14 and the delivery pipe 131 based on a siphon principle. The working mechanism of the suction device 12 is described as follow. First, the suction device 12 sucks gas. After the liquid level of the liquid inside the print cartridge 13 is higher than the preliminary altitude h, i.e. the amount of the liquid inside the print cartridge 13 is increased and the liquid level of the liquid reaches the height h2 as shown in FIG. 1C, the suction device 12 sucks the excess liquid 15 and recycles the excess liquid 15 back into the liquid supply tank 11. Hence, the liquid level of the liquid inside the print cartridge 13 is recovered to the preliminary altitude h as shown in FIGS. 1A and 1D, so the negative pressure inside the print cartridge 13 is restored to a preliminary value. Therefore, the print quality can be maintained, and the problem of ink leakage can be prevented.

The working time of the suction device 12 is calculated and defined by the working software based on the amount of the liquid 15 that nozzles of the print cartridge 13 spray out. The suction device 12 sucks the interior space of the print cartridge 13. Then, the suction device 12 introduces the liquid 15 from the liquid supply tank 11 into the print cartridge 13. The amount of the liquid 15 introduced into the print cartridge 13 is more than the used amount of the liquid 15, to make the liquid level over the predetermined liquid supplementing altitude h1 of the print cartridge 13, in order to prevent the problem of insufficient ink supplement. In the present embodiment, the liquid 15 is supplied to make the liquid level over the height h2, i.e. a safe amount of liquid is introduced into the print cartridge 13. Then, the excess liquid 15 over the preliminary altitude h and between the height h2 is recycled back into the liquid supply tank 11 by the suction device 12. The liquid level of the liquid inside the print cartridge 13 is restored to the preliminary altitude h, i.e. the liquid level is at a position of the bottom of the suction pipe 132, so that the suction device 12 cannot suck any liquid 15 from the suction pipe 132. At the same time, the suction device 12 stops the suction process based on the result calculated by the working software of the inkjet printing system, and the negative pressure inside the print cartridge 13 can also be restored into the preliminary value.

According to the continuous liquid supply device 10 of the present embodiment, there is an altitude difference H between the liquid supply tank 11 and print cartridge 13. The altitude difference H can provide a negative pressure to the print cartridge 13 for normal printing. In addition, the suction device 12 sucks the gas inside the print cartridge 13, so the liquid 15 stored inside the liquid supply tank 11 can be automatically introduced into the print cartridge 13 through the first connection pipeline 14 and the delivery pipe 131 based on a siphon principle. Then, the suction device 12 recycles the excess liquid in the print cartridge 13, so the altitude of the liquid 15 inside the print cartridge 13 can be maintained in a predetermined height. After the liquid 15 is supplied into the print cartridge 13, the negative pressure of the print cartridge 13 can be restored into the preliminary value. Hence, the print quality can be kept and the problem of liquid leakage can be prevented. Even though the liquid supply tank 11 of the continuous liquid supply device 10 of the present embodiment has to be replaced, the suction device 12 can balance the negative pressure inside the print cartridge 13.

Figure 2:
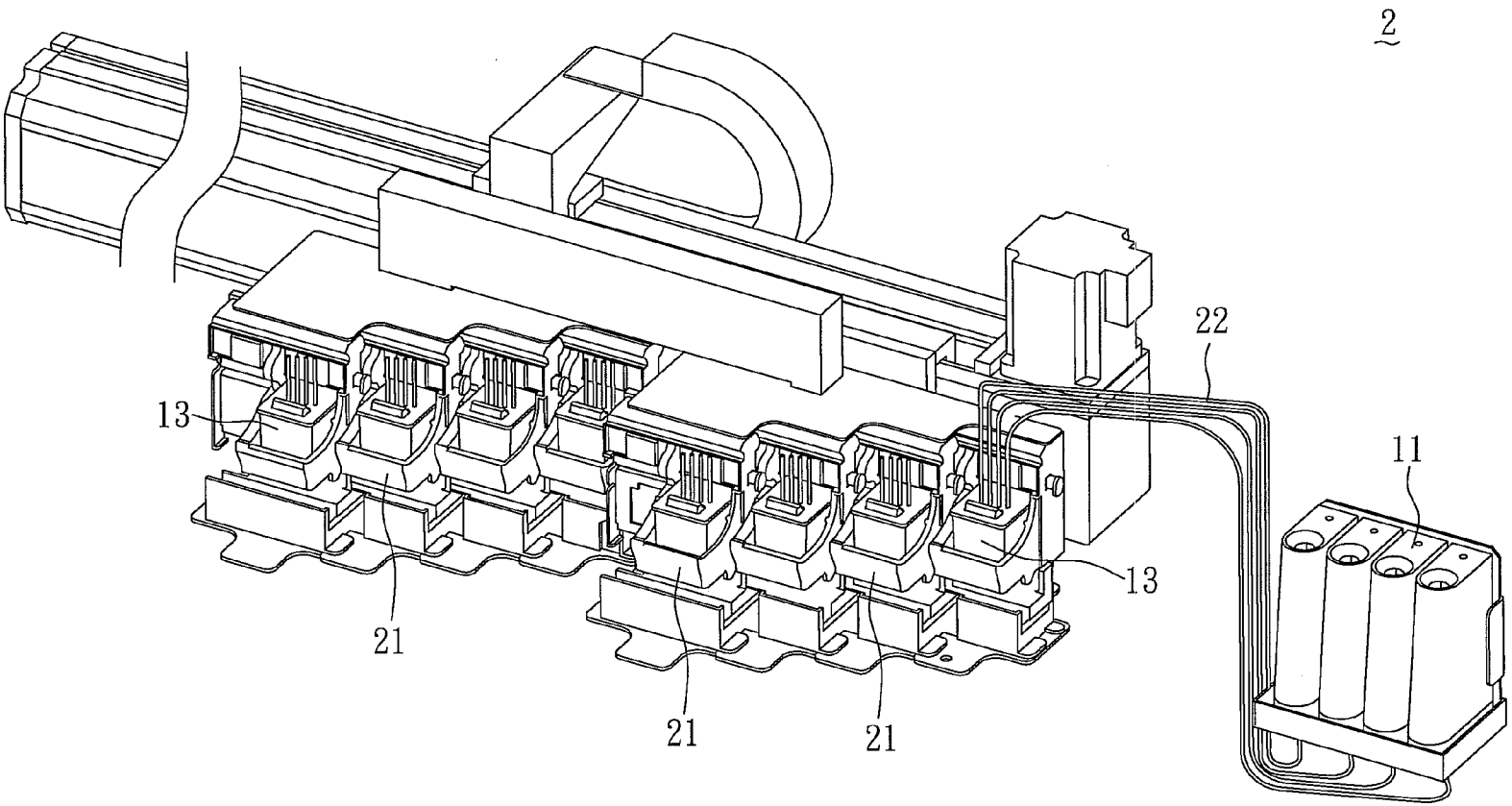
FIG. 2 is a perspective view showing a print device of an inkjet printing system according to the present invention.

The inkjet printing system of the present invention is applied to the industrial field. FIG. 2 is a perspective view showing a print device of an inkjet printing system according to the present invention. As shown in FIG. 2, the print device 2 comprises plural print cartridges 13, and each print cartridge 13 is correspondingly disposed in the carrier 21. Each print cartridge 13 respectively connects to the liquid supply tank 11 through a connection pipeline 22, to continuously introduce the liquid 15 stored inside the liquid supply tank 11 into the print cartridges 13. In addition, an internal pressure-adjusting device (not shown in the figure) is provided to balance the negative pressure inside the print cartridge 13. Furthermore, plural print cartridges 13 are staggered, i.e. there is a fixed relative position between two adjacent print cartridges 13. When a large-area printing process is performed, the printing time can be effective reduced, and the requirement of steady printing quality, low print cost, and high print speed can be obtained.

Figure 3:
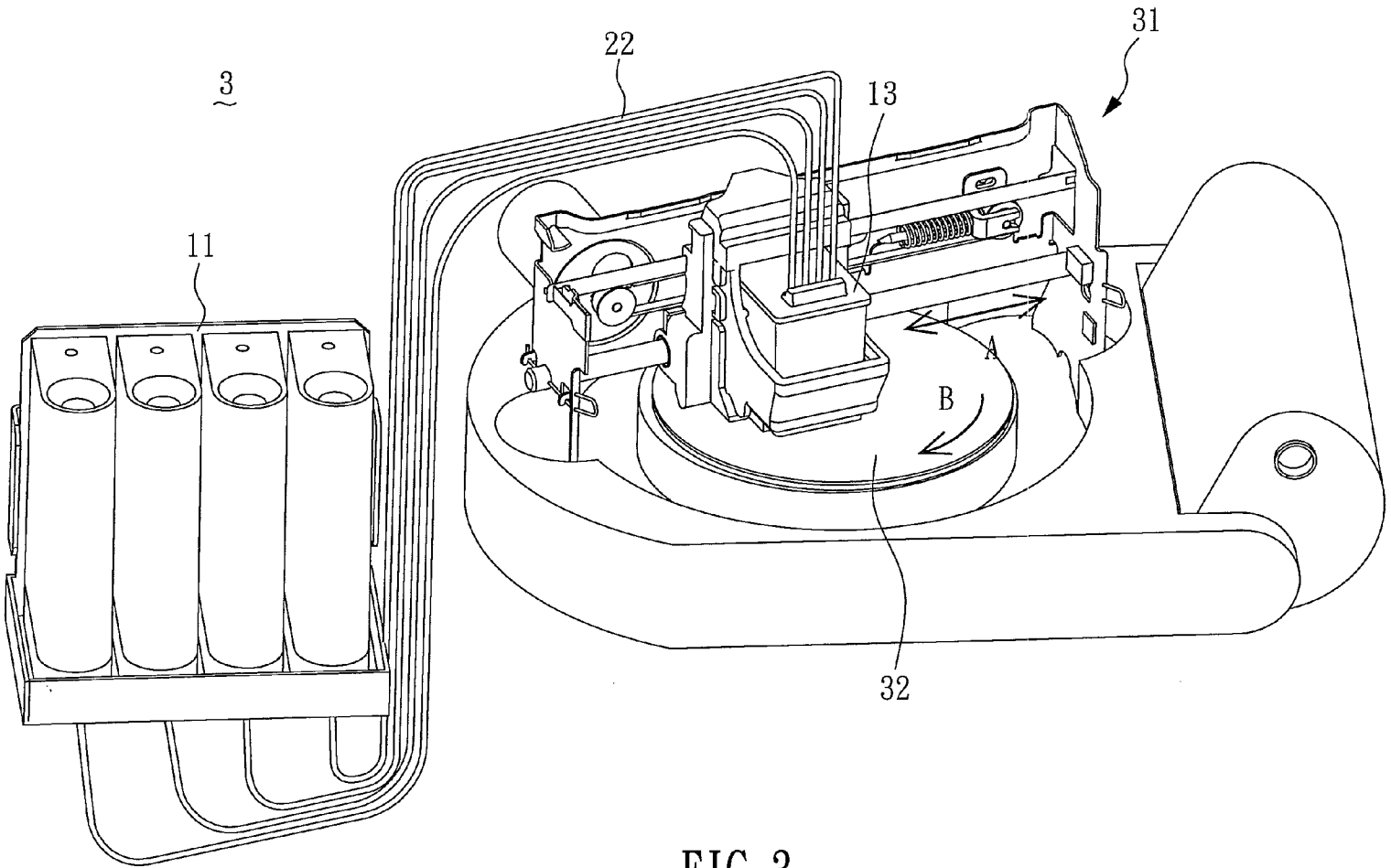
FIG. 3 is a perspective view showing an inkjet printing system according to a preferred embodiment of the present invention.

FIG. 3 is a perspective view showing an inkjet printing system according to a preferred embodiment of the present invention. As shown in FIG. 3, the inkjet printing system 3 of the present embodiment comprises a liquid supply tank 11, a print device 31, and an internal pressure-adjusting device (not shown in the figure). The print device 31 comprises a print cartridge 13, which connects to the liquid supply tank 11 through a connection pipeline 22. Herein, the working mechanism between the print cartridge 13, the liquid supply tank 11 and the internal pressure-adjusting device of the continuous liquid supply device is omitted, because it is the same as that shown in FIGS. 1A to 1D and the corresponding description thereof.

As shown in FIG. 3, the inkjet printing system 3 of the present embodiment can be a printer for printing a print medium 32 such as a disc. The print cartridge 13 performs reciprocation motion along a straight path according to the direction A, so the print cartridge 13 can print on the print medium 32, which rotates according to the direction B. A relative rotation is intermittently performed between the print cartridges 13 and the print medium 32. More specifically, when the print cartridge 13 performs the printing process along a straight path, the print medium 32 is kept in a static state; and when the print medium 32 rotates, the print cartridge 13 is kept in a static state. After the print cartridge 13 prints a straight line on the print medium 32 according to the direction A, the print medium 32 is rotated by an angle, and the print cartridge 13 further prints a straight line on the print medium 32. The aforementioned steps are repeated until the whole printing process on the print medium 32 is completed.

Figure 4:
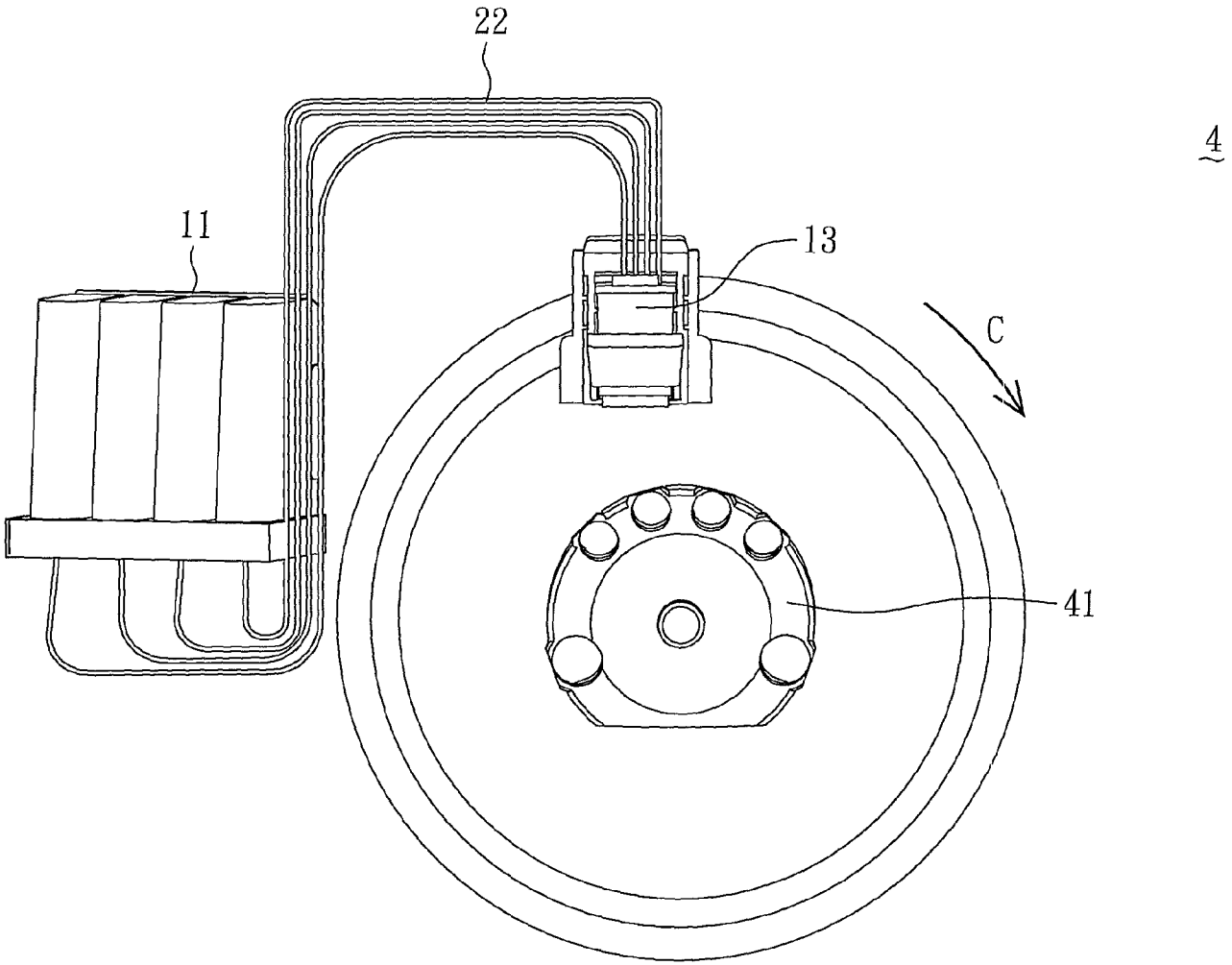
FIG. 4 is a perspective view showing an inkjet printing system according to another preferred embodiment of the present invention.

FIG. 4 is a perspective view showing an inkjet printing system according to another preferred embodiment of the present invention. As shown in FIG. 4, the inkjet printing system 4 of the present embodiment comprises a liquid supply tank 11, a print device, and an internal pressure-adjusting device (not shown in the figure). The print device comprises a print cartridge 13 and a fixed base 41, which is used to fix a print medium with a curved surface (not shown in the figure). The print cartridge 13 connects to the liquid supply tank 11 through a connection pipeline 22. In addition, the working mechanism between the print cartridge 13, the liquid supply tank 11 and the internal pressure-adjusting device of the continuous liquid supply device is omitted, because it is the same as that shown in FIGS. 1A to 1D and the corresponding description thereof.

As shown in FIG. 4, the inkjet printing system 4 is a circular print device. Herein, a fixed altitude is kept between the print cartridge 13 and the print medium, and the print cartridge 13 can perform the printing process on the curved surface of the print medium along the circular path. For example, the print cartridge 13 can perform a circular printing process according to the direction C. In addition, the surface of the print medium is not limited to a flat surface.

The print quality of the inkjet printing system to a print medium depends on the altitude between the print cartridge and the print medium. Hence, the inkjet print system can provide a device to press and flatten the surface of the print medium. According to the inkjet printing system of the present embodiment, an altitude difference between the print medium and the print cartridge can be maintained in a rage of 0.8 mm to 1.5 mm. When the print media are continuously disposed on the printing platform, various means can be used to hold and fix the print media during the printing process, in order to prevent the problem of the displacement caused by the external force.

The present provides the following means for fixing the print medium.

Tension Fixation

Figure 5:
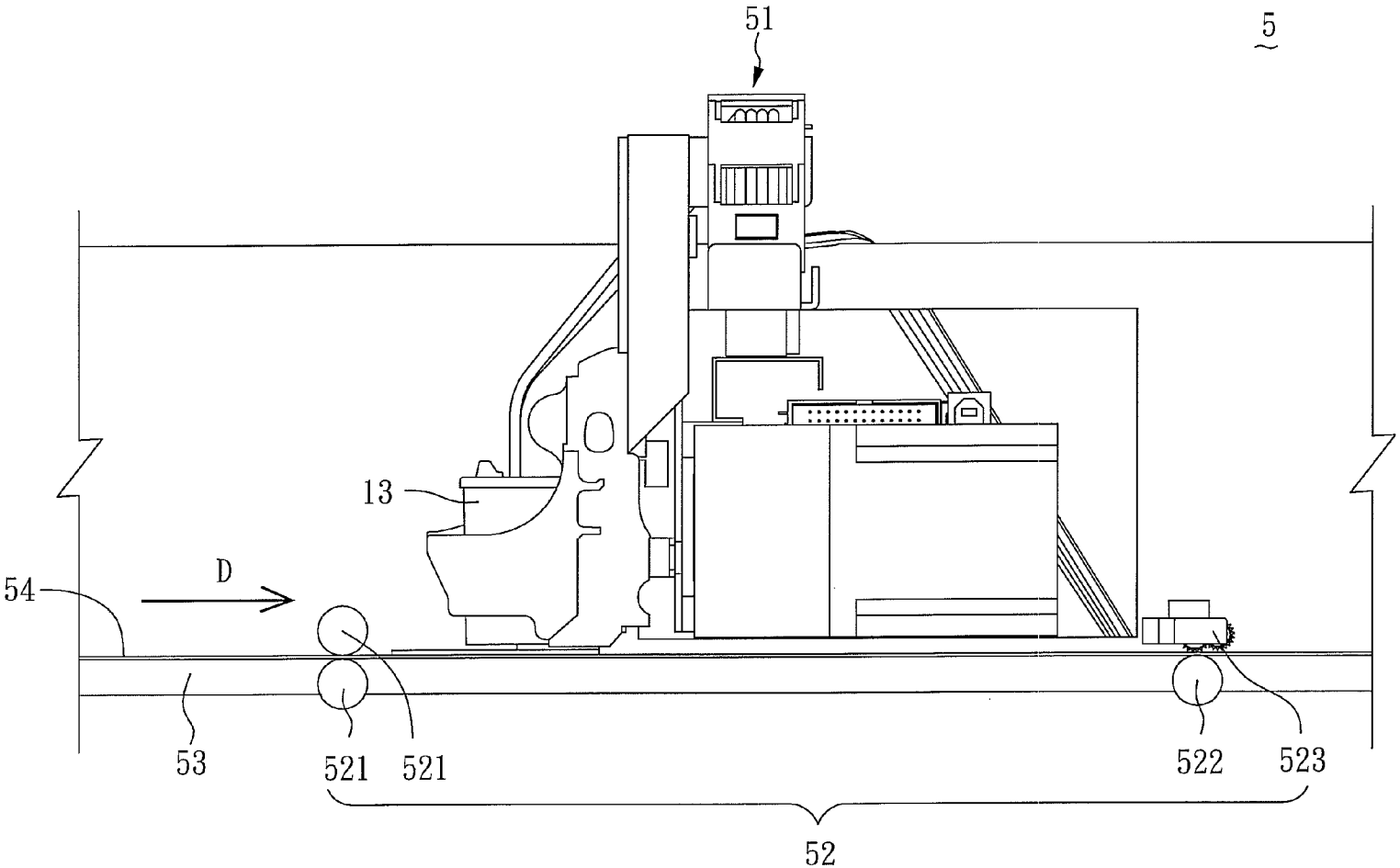
FIG. 5 is a cross-sectional view showing an inkjet printing system according to further another preferred embodiment of the present invention.

FIG. 5 is a cross-sectional view showing an inkjet printing system according to further another preferred embodiment of the present invention. As shown in FIG. 5, the inkjet printing system 5 of the present embodiment comprises a print device 51, a fixed assembly 52, and a printing platform 53. The print device 51 is disposed on the printing platform 53, and comprises a print cartridge 13. The print cartridge 13 prints on print media 54, which is placed on the printing platform 53. The print media 54 is moved along a straight path according to the direction D, and the print device 51 moves and prints along a straight path. The fixed assembly 52 comprises entrance rollers 521, exit rollers 522, and ratchets 523. In addition, the fixed assembly 52 is used for pressing and flattening the print media 54. When the print media 54, which are flexible objects such as flexible plates, are continuous supplied, the print media 54 are delivered into the print device 51 by the entrance rollers 521. After the print media 54 is printed, the print media 54 are output by the exit rollers 522. Herein, the rolling speed of the exit rollers 522 has to be 2-5% greater than that of the entrance rollers 521. The pressure that the ratchets 523 apply on the print media 54 is lower than the pressure that the entrance rollers 521 apply on the print media 54. The contact surface of the ratchets 523 is small pins, so the ratchets 523 may not deteriorate the print media 54. In addition, the ratchets 523 are passive wheels, and they can release the friction generated by the difference between the entrance rollers 521 and the exit rollers 522.

Fixation by Magnetic Force

When the print medium is an object with magnetism, it can be placed on a printing platform with magnetic force. When a magnetic device works, the print medium can attach to the printing platform, to perform the printing process.

Adhesion

An adhesive material is used as a medium for attaching a print medium to a printing platform. Herein, the medium can be any adhesive material such as glue or twin adhesive.

Fixation with Attraction and Vacuum Suction

A strong attraction device is used for placing a print medium on a printing platform. Alternatively, the print medium can be attracted on the printing platform to perform a printing process by a vacuum suction device.

In conclusion, according to the inkjet printing system of the present invention, there is an altitude difference between the print cartridge and the liquid supply tank. In addition, the working software of the inkjet printing system of the present invention can calculate and define a preliminary altitude of the print cartridge, a predetermined liquid supplementing altitude of the print cartridge, and a working time of the internal pressure-adjusting device. When a liquid level of a liquid inside the print cartridge is lower than the preliminary altitude and below a lower limit of the predetermined liquid supplementing altitude, the working software controls the internal pressure-adjusting device to suck partial gas from the print cartridge and recycle excess liquid in the print cartridge into the liquid supply tank. In addition, the internal pressure-adjusting device can automatically introduce the liquid stored in the liquid supply tank into the print cartridge, so the negative pressure inside the print cartridge can be restored to a preliminary value. Hence, the purpose of steady printing quality can be accomplished, and the problem of ink leakage can be prevented. Besides, the positions of plural print cartridges are staggered in the print device, so a large-area printing process can be performed rapidly. In addition, the print device of the present invention can print along a non-straight path. Furthermore, a fixed altitude between the print cartridge and the printing medium can be maintained by use of the inkjet printing system of the present invention.

Although the present invention has been explained in relation to its preferred embodiment, it is to be understood that many other possible modifications and variations can be made without departing from the spirit and scope of the invention as hereinafter claimed.

What is claimed is:

1. An inkjet printing system, comprising:

a liquid supply tank for storing a liquid;

a print device for performing a printing process on a print medium, wherein the print device comprises at least one print cartridge, each print cartridge is provided with plural nozzles, and there is an altitude difference between the print cartridge and the liquid supply tank;

an internal pressure-adjusting device, which connects to the liquid supply tank and the print cartridge, and performs a suction process on the print cartridge; and working software for calculating and defining a preliminary altitude of the print cartridge, a predetermined liquid supplementing altitude of the print cartridge, and a working time of the internal pressure-adjusting device;

wherein when a liquid level of a liquid inside the print cartridge is lower than the preliminary altitude and below a lower limit of the predetermined liquid supplementing altitude, the working software controls the internal pressure-adjusting device to suck partial gas from the print cartridge into the liquid supply tank to increase a negative pressure inside the print cartridge, and the liquid stored in the liquid supply tank is introduced into the print cartridge to balance the negative pressure inside the print cartridge.

2. The inkjet printing system as claimed in claim 1, wherein the negative pressure inside the print cartridge is maintained in a rage of −4 mmHg to −12 mmHg.

3. The inkjet printing system as claimed in claim 1, wherein the internal pressure-adjusting device is a suction device.

4. The inkjet printing system as claimed in claim 3, wherein the working time of the suction device is calculated and defined by the working software based on the amount of the liquid that nozzles of the print cartridge spray out, to restore the negative pressure inside the print cartridge to a preliminary value.

5. The inkjet printing system as claimed in claim 1, wherein the print device comprises plural print cartridges, and the print cartridges are staggered.

6. The inkjet printing system as claimed in claim 1, wherein a relative rotation is intermittently performed between the print cartridges and the print medium.

7. The inkjet printing system as claimed in claim 1, wherein the print cartridge performs the printing process on the print medium along a circular path.

8. The inkjet printing system as claimed in claim 7, wherein the print medium has a curved surface, the print device comprises a fixed base for fixing the print medium, and the print cartridge performs the printing process on the curved surface of the print medium along the circular path.

9. The inkjet printing system as claimed in claim 1, wherein the print device further comprises a fixed assembly, the fixed assembly presses a surface of the print medium to keep a fixed altitude between the print cartridge and the print medium.

10. The inkjet printing system as claimed in claim 9, wherein the fixed altitude is 0.8-1.5 mm.

11. The inkjet printing system as claimed in claim 9, wherein the print medium is pressed through tension, magnetic force, adhesion, or attraction and vacuum suction provided by the fixed assembly.

* * * * *